United States Patent [19]

Richter et al.

[11] Patent Number: 5,007,565

[45] Date of Patent: Apr. 16, 1991

[54] INTEGRAL VENT TUBE

[75] Inventors: Simon J. Richter, Marietta, Ga.; Frank G. Hohmann, Denville, N.J.

[73] Assignee: The Coca-Cola Company, Atlanta, Ga.

[21] Appl. No.: 2,991

[22] Filed: Jan. 13, 1987

Related U.S. Application Data

[63] Continuation of Ser. No. 623,192, Jun. 21, 1984, abandoned.

[51] Int. Cl.[5] ..... B67D 3/00

[52] U.S. Cl. ..... 222/481; 222/478

[58] Field of Search ..... 222/481.8, 481, 478, 222/188, 468; 215/1 C, 11 B, 307, 309; 220/90, 66

[56] References Cited

U.S. PATENT DOCUMENTS

| | | | |
|---|---|---|---|
| 1,319,747 | 10/1919 | Avery | 220/66 |
| 1,438,899 | 12/1922 | Cassidy | 215/309 |
| 1,667,821 | 5/1928 | Rhodes | 222/478 |
| 1,771,106 | 7/1930 | Wright . | |
| 2,516,728 | 7/1950 | Smith . | |
| 2,812,120 | 11/1957 | Beall | 222/481.5 |
| 3,069,039 | 12/1962 | Stickney . | |
| 3,186,607 | 6/1965 | Lubenow . | |
| 3,232,495 | 2/1966 | Schneider . | |
| 3,993,223 | 11/1976 | Welker et al. | 222/541 |
| 4,134,510 | 1/1979 | Chang | 220/72 |
| 4,216,885 | 8/1980 | Sedam | 222/481 |
| 4,356,926 | 11/1982 | Priestly et al. . | |
| 4,412,633 | 11/1983 | Guerrazzi et al. . | |
| 4,438,061 | 3/1984 | Richter et al. . | |

FOREIGN PATENT DOCUMENTS

| | | | |
|---|---|---|---|
| 277290 | 8/1913 | Fed. Rep. of Germany | 215/11 B |
| 1349530 | 4/1974 | United Kingdom | 222/478 |

*Primary Examiner*—H. Grant Skaggs

*Attorney, Agent, or Firm*—Birch, Stewart, Kolasch & Birch

[57] ABSTRACT

A disposable container for use as a syrup package in a post-mix beverage dispenser comprising a base end and a discharge end opposite thereto, sidewalls extending from the base end towards the discharge end, and a neck connecting the sidewalls to the discharge end and defining a discharge opening through which syrup or flavor concentrate may be dispensed. A flow-rate control tube having an openable, sealed end and a closed end is integrally formed with the container sidewalls. The flow-rate control tube has the openable, sealed end positioned in the container base end and has a major portion which extends substantially longitudinally of the container on the outside of the sidewalls, to an associated minor portion of the tube, which extends through the neck of the container so that the open end of the tube is in communication with the interior of the container in the neck region.

38 Claims, 3 Drawing Sheets

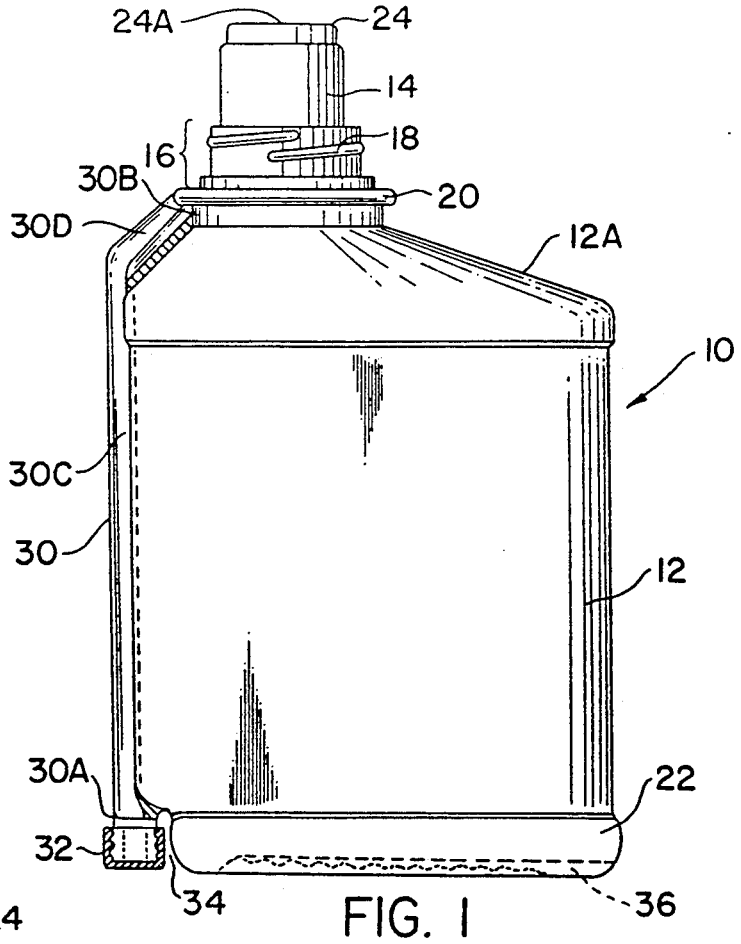
FIG. 1
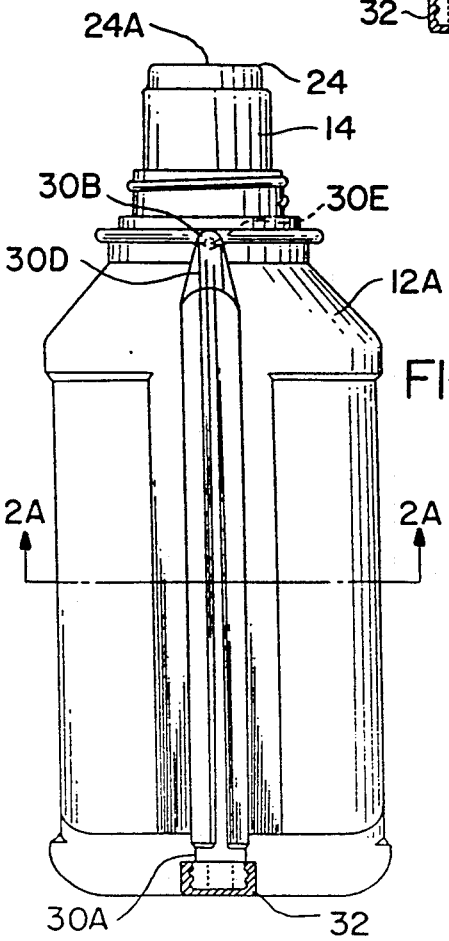
FIG. 2
FIG. 2A
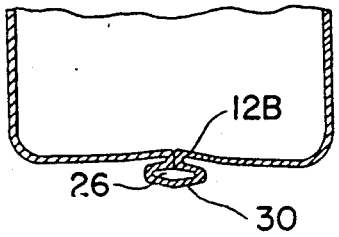

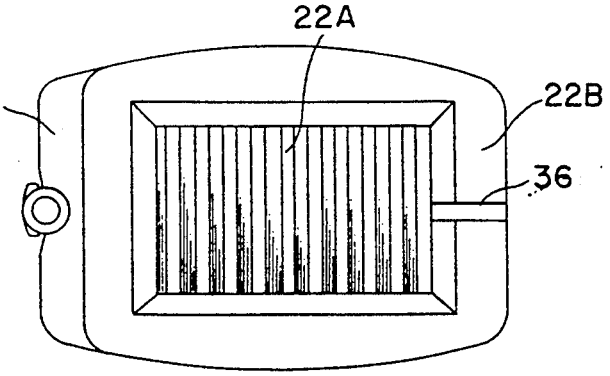
FIG. 3
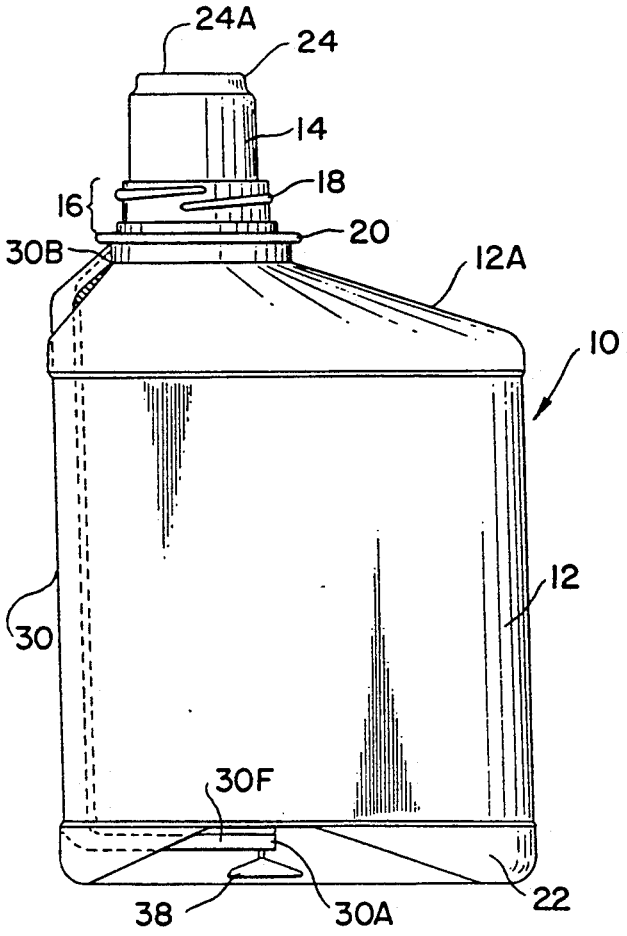
FIG. 4
FIG. 5
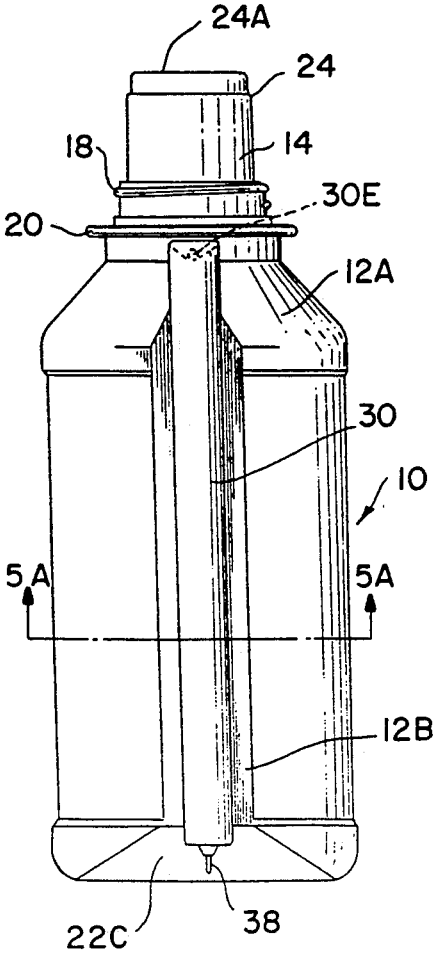

INTEGRAL VENT TUBE

This application is a continuation of copending application Ser. No. 623,192, filed on June 21, 1984, now abandoned.

BACKGROUND OF THE INVENTION

The present invention relates to a syrup package for use with a post-mix beverage dispenser including a flow-rate control tube therein. More specifically, the present invention relates to a disposable syrup container having an integrally formed, flow-rate control tube therein.

In post-mix beverage dispensers in which syrup or flavor concentrate are dispensed from containers by gravity, it is desirable to control the rate of flow of syrup from the containers to ensure that the resulting beverage has a consistent quality and proportions. One preferred way of effecting this flow control is by means of a flow-rate control tube, positioned within the syrup container, and having an openable, sealed end extending through the container base, and an open end disposed within the container at a predetermined position from the discharge end and the dispensing opening thereof An example of such a syrup package is fully disclosed in U.S. Pat. No. 4,216,885, issued Aug. 12, 1980 to Jason K. Sedam, and assigned to the same assignee as the present invention.

The syrup package disclosed in the Sedam Patent works quite well if the flow-rate control tube therein is properly and accurately positioned through the base end of the container with its open end properly positioned with respect to the discharge opening of the container. However, in mass production of the Sedam syrup containers, sophisticated tube insertion machines are required in order to insert the tubes through the base of the container, to achieve proper positioning of the tube in a rapid and efficient manner. Tube insertion machinery of the type described is disclosed in U.S. Pat. No. 4,438,061, issued Mar. 20, 1984 to Simon J. Richter and Ardashus A. Aykanian, and assigned to the same assignee as the present invention.

In addition, with the Sedam syrup package, the container and flow-rate control tube must be separately manufactured, and the tube must be inserted into the container in a separate step, following the formation of the container, which slows down the overall manufacturing process to a significant degree.

Accordingly, the Sedam syrup package construction and the method of making the same has a higher cost and lower speed of manufacture than desired, and may experience difficulties in achieving proper positioning of the flow-rate control tube within the container under high production conditions.

SUMMARY OF THE INVENTION

Accordingly, it is a primary object of the present invention to provide a gravity-flow, syrup package with an accurately-positioned flow-rate control tube therein, which may be accurately and efficiently manufactured in a high speed production line.

It is another object of the present invention to provide a low-cost gravity-flow syrup package for a post-mix beverage dispenser wherein the flow-rate control tube is integrally formed with the container, eliminating the need for separate and special machinery for inserting a flow-rate control tube therein.

It is a further object of the present invention to provide a method for blow-molding a container for use as a gravity-flow, syrup package in a post-mix beverage dispenser wherein the container and a flow-rate control tube therefor are simultaneously formed by the blow-molding process.

It is still another object of the present invention to provide a flow-rate control tube for a gravity-flow, syrup package having a shape which enhances air flow and thus venting of the interior of the container.

It is yet another object of the present invention to provide a gravity-flow dispensing container having a base end which does not collect liquids or condensation, which might tend to drain into the flow-rate control tube and contaminate the beverage being formed.

The objects of the present invention are fulfilled by providing a container having a base end and a discharge end opposite thereto, sidewalls extending from the base end towards the discharge end, and a neck connecting the sidewalls to the discharge end and defining a discharge opening through which syrup or flavor concentrate may be dispensed. A flow-rate control tube having an openable, sealed end and an open end is integrally formed with the container sidewalls. The flow-rate control tube has the openable, sealed end positioned in the container base end and has a major portion which extends substantially longitudinally of the container on the outside of the sidewalls, to an associated minor portion of the tube, which extends through the neck of the container so that the open end of the tube is in communication with the interior of the container in the neck region.

To enhance air flow of the tube, the major portion of the tube may have a predetermined, inside diameter, permitting the free flow of air therethrough, and the minor portion of the tube may have a reduced inside diameter smaller than the predetermined diameter of the major portion which gradually decreases toward the open end of the tube to limit the size of any air bubbles which might be formed and minimize syrup pressure and flow rate fluctuations. The container neck has a finish thereon, such as screw threads, for releasably receiving a protective cap over the discharge opening of the container. The open end of the flow-rate control tube passes through the container neck at a position as close as possible to this finish without interfering with the operation of the protective cap. In a preferred embodiment, a grip ring is provided just below the finish, and the open end of the flow-rate control tube passes through the grip ring.

The base end of the container, which is the bottom end of the container during storage, but becomes the top end of the container once it is inverted and inserted into a post-mix beverage dispenser, is provided with a recess surrounded with an annular shoulder. In one embodiment, the surface of the recess slopes away from the openable, sealed end of the flow-rate control tube toward a drainage opening formed in a shoulder surrounding the recess, to permit the drainage of liquids such as condensation in a direction away from the flow-rate control tube. The base end may also be corrugated for added strength. The base end also includes an offset through which the flow rate control tube passes and in which the openable, sealed end thereof is contained to help protect the same from damage during shipping and handling.

The container structure of the present invention is particularly advantageous in that the entire container and associated flow-rate control tube may be integrally formed simultaneously by a blow-molding process. This increases the speed of manufacture and reduces the costs thereof since separate machinery is not required for forming the tube and then inserting the same into the container.

BRIEF DESCRIPTION OF THE DRAWINGS

The objects of the present invention and the attendant advantages thereof will become more readily apparent by reference to the following drawings, wherein like reference numerals refer to like parts, and further wherein:

FIG. 1 is a front elevational view, partially in section, illustrating a preferred embodiment of the syrup package of the present invention;

FIG. 2 is a side elevational view of the left side of the syrup package of FIG. 1;

FIG. 2A is a cross-sectional view taken along lines A—A of the syrup package of FIG. 2;

FIG. 3 is a bottom plan view of the syrup package of FIG. 1;

FIG. 4 is a front elevational view of another embodiment of the syrup package of the present invention;

FIG. 5 is a side elevational view of the left side of the syrup package of FIG. 4;

DESCRIPTION OF THE PREFERRED EMBODIMENTS

Figure 5A:
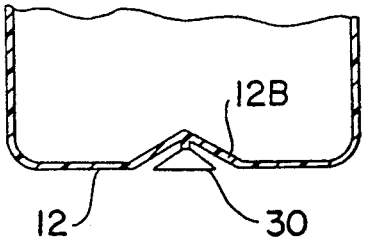
FIG. 5A is a cross-sectional view taken along lines A—A of the syrup package of FIG. 5.

Referring to the preferred embodiment of FIGS. 1 to 3, there is illustrated a syrup package, generally indicated 10, in an upright position wherein it rests on a base end 22. The package 10 will occupy this upright position during shipping and storage, but it should be understood that it will be inverted for insertion into a post-mix beverage dispenser with the base end 22 up, and the discharge end 24 with discharge opening 24A pointed downwardly into a socket associated with a valving mechanism. An exemplary socket and valving mechanism is described in U.S. Pat. No. 4,426,019, issued Jan. 17, 1984 to Jason K. Sedam, and assigned to the same assignee as the present invention. The syrup package or container 10 of the present invention includes sidewalls 12 extending from base end 22 towards discharge end 24, which slope to a funnel-shaped portion 12A, which terminates at a neck portion 14. The neck portion 14 has a finish 16 thereon, including threads 18 for receiving a screw-on, protective cap to be further described hereinafter with respect to FIG. 7.

The syrup package 10 is further provided with a flow-rate control tube 30, including a major portion 30C integrally formed, such as by blow-molding, with sidewalls 12 and a minor portion 30D integrally formed with the funnel-shaped portion 12A of the sidewalls of the package. The flow-rate control tube has an openable, sealed end 30A and an open end 30B with an opening 30E therein. The open end 30B with opening 30E passes through the neck 14 of the container through the grip ring 20 at a point juxtaposed to the finish 16. This location of the opening 30E is particularly important to provide flow-rate control to a maximum amount of fluid within the container 10. That is, it is positioned as close as possible to the discharge opening 24A without interfering with the finish 16 because flow-rate control of the liquid is only provided by the tube 30 between the confines of the open end 30E and the base end 22 of the container.

The major portion 30C of the flow-rate control tube 30 has a predetermined inside diameter or cross-section 26, which is larger than the opening 30E at the point of entry of the tube into the neck of the container. The relative size of the inside diameter or cross-section 26 and the opening 30E are illustrated in FIGS. 2 and 2A. Also illustrated in FIG. 2 is the manner in which the sidewalls of the minor portion 30D of tube 30 taper from the sidewalls of the major portion 30C, toward the opening 30E. This tapering of the sidewalls and relative size of the opening 30E with respect to the inside diameter 26 of the tube limit the size of any air bubbles which might be formed and minimize syrup pressure and flow rate fluctuation since the minor portion 30D thereof is in the shape of a nozzle. The openable, sealed end of the tube 30A in the embodiment of FIGS. 1 to 3 includes a screw-on cap 32 disposed within an offset 34 in the base end 22 of the container. The location of end 30A in this offset helps protect the tube from damage during shipping and handling. Tube 30 is also partially recessed within a portion 12B of the sidewalls of the container 10, to further assist in the protection of the tube from damage. This recess 12B is best illustrated in the cross-sectional view of FIG. 2A.

The base end of the container 10 is provided with a recess 22A, which may be corrugated for extra strength, and a shoulder 22B surrounding the recess. In one embodiment, the recess 22A is sloped away from the openable, sealed end 30A of tube 30, as illustrated in FIG. 1, toward a drainage opening 36 passing through the shoulder 22B. This sloping of the recess precludes the accumulation of moisture such as condensation therein and directs the drainage of any such moisture or condensation away from the openable, sealed end of the tube. That is, when the syrup package 10 is inverted and inserted into a post-mix beverage dispenser, the base ends 22 become the top of the container, and it is advantageous to provide means such as drain 36 and the sloped recess 22A to permit drainage of any condensation or liquid therefrom.

Figure 6:
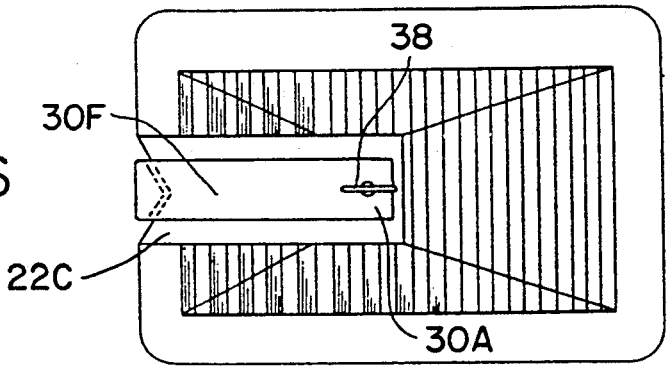
FIG. 6 is a bottom plan view of the syrup package of FIG. 4.

Referring in detail to FIGS. 4 to 6, there is illustrated a syrup package 10 wherein like reference numerals are applied to like parts of the syrup package of FIGS. 1 to 3. The syrup package of FIGS. 4 to 6 differs slightly from that of FIGS. 1 to 3 in that the flow-rate control tube 30 has an additional minor portion 30F which wraps around the base end 22 of the package into a recess 22C, and terminates at the closed end 30A thereof at approximately the mid point of the base end 22 of the package. In addition, the openable, sealed end 30A is provided with a twist-off, frangible member 38 to open the same once the package is inverted and inserted for use in a post-mix beverage dispenser.

As illustrated in FIG. 5A, the recess in sidewall portion 12B is more pronounced than in the FIG. 1 to 3 embodiment, so that the tube 30 is sufficiently recessed so that its outside surface is essentially flush with the sidewalls 12 of the package 10 Another difference with respect to the two embodiments of the present invention is that the opening 30 in the embodiment of FIGS. 4 to 6 is circular, rather than the triangular-shaped opening 30E of the FIGS. 1 to 3 embodiment.

Figure 7:
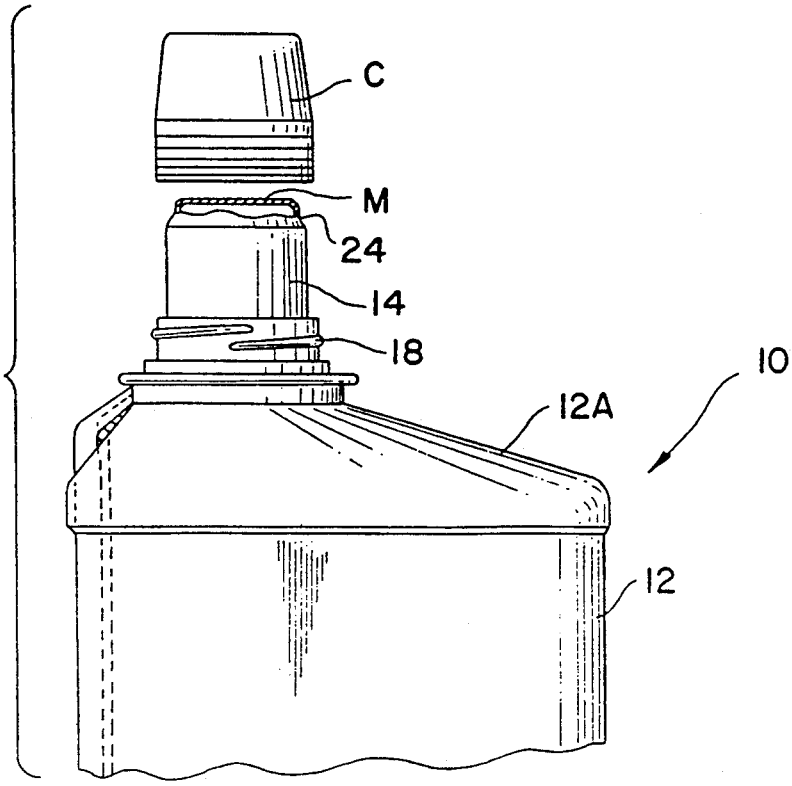
FIG. 7 is an exploded view illustrating how the discharge opening and neck portion of the syrup packages of FIGS. 1 to 6 are covered with a frangible membrane and protective cap, to provide a hermetically-sealed container.

FIG. 7 illustrates how the discharge end 24 of container 1 0 is sealed to form the hermetically-sealed syrup package of the present invention. As illustrated, a frangible membrane M is secured over the discharge opening by a suitable heat sealing technique or a suitable adhesive An alternative method of securing the membrane M is by ultrasonic welding. A protective cap C, including threads which mate with threads 18 on the finish of the container neck 14, is then screwed on the container neck over the membrane M. The package is shipped in this condition, and the cap C is removed prior to plugging the container neck 14 into the aforementioned socket in the valving mechanism of the post-mix beverage dispenser. The membrane seal M is punctured by a suitable cutting device within the socket, to permit the flow of syrup or flavor concentrate from the package.

The container of the present invention may be blow-molded from any suitable thermoplastic material such as high- or low-density polyethylene, polypropylene, polycarbonate acetate, acrylonitrile-butadiene styrene (ABS), and the like.

The foregoing specification and the drawings are intended as illustrative, and are not to be taken as limiting. Still other variations and rearrangements of parts within the spirit and scope of the present invention are possible, and will readily present themselves to one skilled in the art.

We claim:

1. A disposable package for dispensing liquids with a controlled rate of flow comprising:

a container having a base end and a discharge end opposite thereto, sidewalls extending from said base end toward said discharge end and a neck connecting the sidewalls to the discharge end and defining a discharge opening through which liquids may be dispensed; and a flow rate control tube having an openable, sealed end and an open end, the tube having the openable, sealed end thereof disposed in the container base end and a major portion extending substantially longitudinally of said container on the outside of said sidewalls, said tube having a minor portion connecting said major portion to said open end of said tube at the container neck, said open end communicating through said neck with the inside of said container, said major portion of said tube having a predetermined inside diameter, permitting the free flow of air therethrough, and said minor portion of said tube having an inside diameter which gradually decreases toward the open end of said tube to limit the size of any air bubbles which might be formed and minimize liquid pressure and flow rate fluctuations.

2. The package of claim 1, wherein said container neck has a finish thereon for releasably receiving a cap over said discharge opening, said open end of said tube communicating through said neck immediately adjacent said finish buy without interfering with said cap.

3. The package of claim 2, wherein said neck has a grip ring formed thereon juxtaposed to said finish and said open end of said tube extends through said grip ring.

4. The package of claim 1, wherein the internal cross-sectional shape of the open end of said tube is substantially triangular.

5. The package of claim 1, wherein said tube is integrally formed with said container sidewalls.

6. The package of claim 1, wherein said container base end has an external recess therein surrounded by a shoulder, said shoulder having at least one drainage opening therethrough to prevent accumulation of liquids in said recess and wherein the exterior surface of said recess slopes away from said openable sealed end toward said drainage opening.

7. The package of claim 6, wherein the exterior surface of said recess is corrugated.

8. The package of claim 1, wherein said openable, sealed end of said tube has a removable cap thereon.

9. The package of claim 1, wherein said openable, sealed end has a frangible tab thereon which may be broken off to open said sealed end.

10. The package of claim 1, wherein said base end of said container has an offset in which said openable, sealed end is at least partially contained.

11. The package of claim 1, further including a frangible membrane over said discharge opening.

12. A disposable package for dispensing liquids with a controlled rate of flow comprising:

a container having a base end and a discharge end opposite thereto, sidewalls extending from said base end toward said discharge end and a neck connecting the sidewalls to the discharge end and defining a discharge opening through which liquids may be dispensed; and a flow-rate control tube integrally formed with said container sidewalls and having an openable, sealed end and an open end, the tube having the openable, an open end thereof disposed in the container base end and a major portion extending substantially longitudinally of said container on the outside of said sidewalls, said tube having a minor portion connecting said major portion to said open end of said tube at the container neck, said open end communicating through said neck with the inside of said container;

said major portion of said tube having a predetermined inside diameter permitting the free flow of air therethrough and said minor portion of said tube having an inside diameter which gradually decreases toward the open end of said tube to limit the size of any air bubbles which might be formed and minimize liquid pressure and flow rate fluctuations;

said container neck having a finish thereon for releasably receiving a cap over said discharge opening, said open end of said tube communicating through said neck immediately adjacent said finish but without interfering with said cap, said neck also having a grip ring formed thereon juxtaposed to said finish and said open neck of said tube extending through said grip ring.

13. The package of claim 12, wherein the internal cross-sectional shape of the open end of said tube is substantially triangular.

14. The package of claim 12, wherein said container base end has an external recess therein surrounded by a shoulder, said shoulder having at least one drainage opening therethrough to prevent accumulation of liquids in said recess and wherein the exterior surface of said recess slopes away from said openable sealed end toward said drainage opening.

15. The package of claim 14, wherein the exterior surface of said recess is corrugated.

16. The package of claim 12, wherein said openable, sealed end of said tube has a removable cap thereon.

17. The package of claim 12, wherein said openable, sealed end has a frangible tab thereon which may be broken off to open said sealed end.

18. The package of claim 12, wherein said base end of said container has an offset in which said openable, sealed end is at least partially contained.

19. The package of claim 12, further including a frangible membrane over said discharge opening.

20. The disposable package for dispensing liquids with a controlled rate of flow comprising:

a container having a base end and a discharge end opposite thereto, sidewalls extending from said base end toward said discharge end and a neck connecting the sidewalls to the discharge end and defining a discharge opening through which liquids may be dispensed; and a flow rate control tube having an openable, sealed end and an open end, the tube having the openable, sealed end thereof disposed in the container base end and a major portion extending substantially longitudinally of said container on the outside of said sidewalls, said tube having a minor portion connecting said major portion to said opened end of said tube at the container neck, said open end communicating through said neck with the inside of said container, said major portion of said tube having a predetermined inside diameter, permitting the free flow of air therethrough, and said minor portion of said tube having an inside diameter which gradually decreases toward the open end of said tube to limit the size of any air bubbles which might be formed and minimize liquid pressure and flow rate fluctuations, the internal cross-sectional shape of the open end of said tube being substantially triangular with an apex of the triangle extending toward the container base end, whereby with the discharge opening directed downwardly the apex of the triangle further limits the size of any air bubbles passing through said open end.

21. The package of claim 20, wherein said container neck has a finish thereon for releasably receiving a cap over said discharge opening, said open end of said tube communicating through said neck immediately adjacent said finish but without interfering with said cap.

22. The package of claim 21, wherein said neck has a grip ring formed thereon juxtaposed to said finish and said open end of said tube extends through said grip ring.

23. The package of claim 20, wherein said tube is integrally formed with said container sidewalls.

24. The package of claim 20, wherein said container base end has an external recess therein surrounded by a shoulder, said shoulder having at least one drainage opening therethrough to prevent accumulation of liquids in said recess.

25. The package of claim 24, whereby the exterior surface of said recess is corrugated.

26. The package of claim 25, wherein the exterior surface of said recess slopes away from said openable, sealed end toward said drainage opening.

27. The package of claim 20, wherein said openable, sealed end of said tube has a removable cap thereon.

28. The package of claim 20, wherein said openable, sealed end has frangible tab thereon which may be broken off to open said sealed end.

29. The package of claim 20, wherein said base end of said container has an offset in which said openable, sealed end is at least partially contained.

30. The package of claim 20, further including a frangible membrane over said discharge opening.

31. A disposable package for dispensing liquids with a controlled rate of flow comprising:

a container having a base end and a discharge end opposite thereto, sidewalls extending from said base end toward said discharge end and a neck connecting the sidewalls to the discharge end and defining a discharge opening through which liquids may be dispensed; and a flow-rate control tube integrally formed with said container sidewalls and having an openable, sealed end and an open end, the tube having the openable, sealed end thereof disposed in the container base end and a major portion extending substantially longitudinally of said container on the outside of said sidewalls, said tube having a minor portion connecting said major portion to said open end of said tube at the container neck, said open end communicating through said neck with the inside of said container;

said major portion of said tube having a predetermined inside diameter permitting the free flow of air therethrough and said minor portion of said tube having an inside diameter which gradually decreases toward the open end of said tube to limit the size of any air bubbles which might be formed and minimize liquid pressure and flow rate fluctuations, the internal cross-sectional shape of the open end of said tube being substantially triangular with an apex of the triangle extending toward the container base end, whereby with the discharge opening directed downwardly the apex of the triangle further limits the size of any air bubbles passing through said open end;

said container neck having a finish thereon for releasably receiving a cap over said discharge opening, said open end of said tube communicating through said neck immediately adjacent said finish but without interfering with said cap, said neck also having a grip ring formed thereon juxtaposed to said finish and said open neck of said tube extending through said grip ring.

32. The package of claim 31, wherein said container base end has an external recess therein surrounded by a shoulder, said shoulder having at least one drainage opening therethrough to prevent accumulation of liquids in said recess.

33. The package of claim 32, wherein the exterior surface of said recess is corrugated.

34. The package of claim 33, wherein the exterior surface of said recess slopes away from said openable, sealed end toward said drainage opening.

35. The package of claim 31, wherein said openable, sealed end of said tube has a removable cap thereon.

36. The package of claim 31, wherein said openable, sealed end has a frangible tab thereon which may be broken off to open said sealed end.

37. The package of claim 31, wherein said base end of said container has an offset in which said openable, sealed end is at least partially contained.

38. The package of claim 31, further including a frangible membrane over said discharge opening.

* * * * *